United States Patent [19]

Ratell

[11] Patent Number: 4,647,894

[45] Date of Patent: Mar. 3, 1987

[54] NOVEL DESIGNS FOR PACKAGING CIRCUIT PROTECTION DEVICES

[75] Inventor: Joseph M. Ratell, Fremont, Calif.

[73] Assignee: Raychem Corporation, Menlo Park, Calif.

[21] Appl. No.: 711,907

[22] Filed: Mar. 14, 1985

[51] Int. Cl.[4] ..... H01C 7/10

[52] U.S. Cl. ..... 338/22 R; 361/12; 361/106; 339/111

[58] Field of Search ..... 338/319, 20, 22 R, 22 SD, 338/239, 260, 320, 322; 361/2, 12, 106; 335/201; 174/52 R; 339/198 R, 111

[56] References Cited

U.S. PATENT DOCUMENTS

| | | | |
|---|---|---|---|
| 1,993,494 | 3/1935 | Weiscopf | 338/260 |
| 3,451,019 | 6/1969 | Aver et al. | 335/201 |
| 4,045,751 | 8/1977 | Schuessler et al. | 335/201 |
| 4,215,380 | 7/1980 | Massey | 339/111 X |
| 4,237,441 | 12/1980 | van Konynenburg et al. | 338/22 R |
| 4,238,812 | 12/1980 | Middleman et al. | 361/106 |
| 4,255,698 | 3/1981 | Simon | 338/22 R X |
| 4,315,237 | 2/1982 | Middleman et al. | 338/22 R |
| 4,317,027 | 2/1982 | Middleman et al. | 338/22 R X |
| 4,329,726 | 5/1982 | Middleman et al. | 338/22 R X |
| 4,352,083 | 9/1982 | Middleman et al. | 338/22 R X |
| 4,413,301 | 11/1983 | Middleman et al. | 361/106 |
| 4,475,138 | 10/1984 | Middleman et al. | 338/22 R X |
| 4,481,498 | 11/1984 | McTavish et al. | 338/22 R X |
| 4,542,365 | 9/1985 | McTavish et al. | 338/22 R X |
| 4,549,161 | 10/1985 | McTavish et al. | 338/22 R X |

*Primary Examiner*—E. A. Goldberg
*Assistant Examiner*—M. M. Lateef
*Attorney, Agent, or Firm*—Timothy H. P. Richardson; Herbert G. Burkard

[57] ABSTRACT

Circuit protection devices which comprise a PTC conductive polymer element and an enclosure, and which are less likely to cause damage to other electrical components through release of carbonaceous dust. On the interior surface of the enclosure, there is a projection or other disconformity which is spaced apart from the electrodes and which provides a site for arc initiation. In this way, the danger of erosion creating a hole in the enclosure is reduced. Preferably each of the electrodes is surrounded by a projection.

20 Claims, 2 Drawing Figures

NOVEL DESIGNS FOR PACKAGING CIRCUIT PROTECTION DEVICES

BACKGROUND OF THE INVENTION

1. Field of the Invention

This invention relates to circuit protection devices comprising PTC conductive polymers.

2. Introduction to the Invention

Conductive polymer compositions exhibiting PTC behavior, and electrical devices comprising them, are well known.

Particularly useful devices comprising PTC conductive polymers are circuit protection devices. Such devices have a relatively low resistance under the normal operating conditions of the circuit, but are "tripped", i.e., converted into a high resistance state, when a fault condition, e.g., excessive current or temperature, occurs. When the device is tripped by excessive current, the current passing through the PTC element causes it to self-heat to an elevated temperature at which it is in a high resistance state. The increase in resistance is accompanied by an expansion of the PTC element along an expansion axis. Such devices, and PTC conductive polymer compositions for use in them, are described for example in U.S. Pat. Nos. 4,237,411, 4,238,812; 4,255,698; 4,315,237; 4,317,027; 4,329,726; 4,352,083; 4,413,301; 4,475,138; and 4,481,498 and in copending commonly assigned U.S. application Ser. Nos. 141,989 and 628,945 and in the commonly assigned patent applications filed contemporaneously with this application by Deep et al, Ser. No. 711,909, by Carlomagno, Ser. No. 711,790, by Au et al, Ser. No. 711,910 and by me, Ser. No. 711,908. The disclosure of each of these patents and pending applications is incorporated herein by reference.

SUMMARY OF THE INVENTION

I have been working on the use of circuit protection devices containing PTC conductive polymer elements in situations in which the device is mounted onto, or itself comprises, an electrically insulating wall which is spaced apart from the PTC element and through which the electrodes pass. The wall is usually part of an enclosure which encloses and is spaced apart from the PTC element, and which is composed of an electrically insulating polymeric material, preferably a thermoset polymer as disclosed in copending, commonly assigned, application Ser. No. 711,908 filed contemporaneously herewith. The wall can be associated with a plurality of protection devices whose electrodes pass through the wall. As noted in U.S. Pat. No. 4,481,498, failure of protection devices based on PTC elements comprising carbon black dispersed in a polymer can result from the formation of a permanent conductive path between the electrodes, as a result of the deposition of carbonaceous dust, evolved from the PTC element when it is tripped, onto a surface which joins the electrodes, typically the interior of an enclosure which surrounds, but is spaced apart from the PTC element. It has been found that improved results are obtained by reducing the likelihood that an arc is struck between the electrodes, via carbonaceous dust deposited on the interior of the enclosure, and by ensuring so far as possible, that if such an arc is struck, the result of the arc is not a permanent conductive path (or "track").

Typically the measures taken to avoid "tracking" result in erosion of the polymeric enclosure, and I have found that under some circumstances this can result in unforeseen disadvantages. In particular, I have found that erosion of the enclosure can result in the electrodes no longer being a tight fit in the exit ports of the enclosure, and/or can result in the creation of holes in the enclosure through which carbonaceous dust can escape and cause undesirable electrical effects, for example by causing short circuits in a printed circuit board onto which the protection device is mounted. In its broadest aspect, this invention includes any novel means for reducing the likelihood of creating holes in the enclosure in this way. In some cases, the likelihood can be reduced by increasing the wall thickness of the enclosure or by increasing the distance between the exit ports. However, in many cases these expedients are insufficient or cannot be employed because of the end use or other requirements of the device, e.g. the need for the electrodes to be connected to a printed circuit board with a fixed separation between the connections and/or the need to keep the dimensions of the device below fixed limits. A preferred method is to provide, on the interior surface of the enclosure, a disconformity such that there is an increased probability that, under at least some of the fault conditions likely to be encountered, when an arc is struck between the electrodes, the arc includes the disconformity, the disconformity being so constructed and arranged that when such an arc is struck, the resultant erosion does not lead to the disadvantages noted above. Thus the disconformity can have a shape and/or a chemical composition which is different from the main part of the enclosure. Preferably the disconformity is in the form of a projection or has some other shape such that the thickness of the carbon black which gathers thereon is relatively small, so that when the arc is struck, the carbon dust can be relatively easily blown away, thus preventing the formation of a "track". Alternatively, the disconformity can be in the form of section, e.g. a band, of a metal, or other relatively good electrical conductor, which is on the interior surface of the enclosure at a position which causes the arc to be struck along a path which does not result in damaging erosion. A particularly effective disconformity is a projection which crosses, preferably substantially at right angles, at least the shortest, and preferably all, of the paths on the interior of the enclosure between the electrodes. The projection is preferably so shaped and located that it provides an area which, relative to the remainder of the interior of the enclosure, is thermally well insulated and on which the thickness of carbon black is relatively small, with a consequently relatively large resistance per unit of path length. It is theorized that as a result, when an arc is struck within the enclosure, the arc includes at least a part of the projection, e.g. its end, on which there is relatively thin layer of carbonaceous dust, so that the arc causes the dust to be blown off the projection, thus preventing the formation of a track. I have obtained particularly good results by providing, around the base of at least one of the electrodes, and preferably around the base of each of the electrodes, a projection which projects towards the PTC element from the wall defining the exit port and which is spaced apart from the electrode. As discussed below, the dimensions of the projection which will give the optimum results depend upon the dimensions of the other parts of the device and the conditions of operation of the device. However, those skilled in the art will have no difficulty, having regard to their own knowledge and the disclosure of this specification, in determining dimensions which will result in a useful improvement.

In a preferred embodiment, the invention provides a circuit protection device which comprises (1) a PTC element composed of a conductive polymer composition which exhibits PTC behavior and which comprises a polymeric component and, dispersed in the polymeric component, carbon black;

(2) two electrodes which are electrically connected to the PTC element and which are connectable to a source of electrical power to cause current to pass through the PTC element; and (3) an enclosure which (a) encloses and is spaced apart from the PTC element; and (b) comprises a first wall portion which contains a first exit port through which passes one of the electrodes, and a second wall portion which contains a second exit port through which passes the other electrode; at least one of said wall portions comprising (i) a base which defines an exit port; and (ii) a projection which projects from the base towards the PTC element, and which is spaced apart from and substantially surrounds the electrode passing through the exit port, the projection being such that its presence substantially reduces erosion of the base when the device is repeatedly converted to a high resistance state under conditions which cause the PTC element to evolve carbonaceous dust.

BRIEF DESCRIPTION OF THE DRAWING

The invention is illustrated in the accompanying drawing, in which.

DETAILED DESCRIPTION OF THE INVENTION

In the preferred embodiment of the invention, the gap between the electrode and the projection should not be too small, since it will then become bridged by the carbonaceous dust. On the other hand, it should preferably not be too big, since the area at the base of the electrode will then also be a likely site for arcing, thus defeating the objectives of the invention. I have found that when at least one of the electrodes is surrounded by a projection, the separation between the electrode and the projection surrounding it is preferably 0.008 to 0.1 inch, particularly 0.010 to 0.060 inch, especially 0.01 to 0.04 inch.

The end of the projection should have a relatively narrow surface, preferably at most 0.050 inch, particularly at most 0.030 inch, especially at most 0.020 inch, e.g. 0.002 to 0.020 inch, wide. Preferably the projection provides a surface which surrounds the electrode in a plane substantially at right angles to the axis of the electrode.

When, as in the preferred embodiment of the invention, at least one and preferably each of the electrodes is surrounded by a projection, the projection preferably has a substantially annular cross-section in all planes at right angles to the axis of the electrode. The projection can be cylindrical, but for ease of manufacture preferably has steeply sloping sides.

Figure 1:
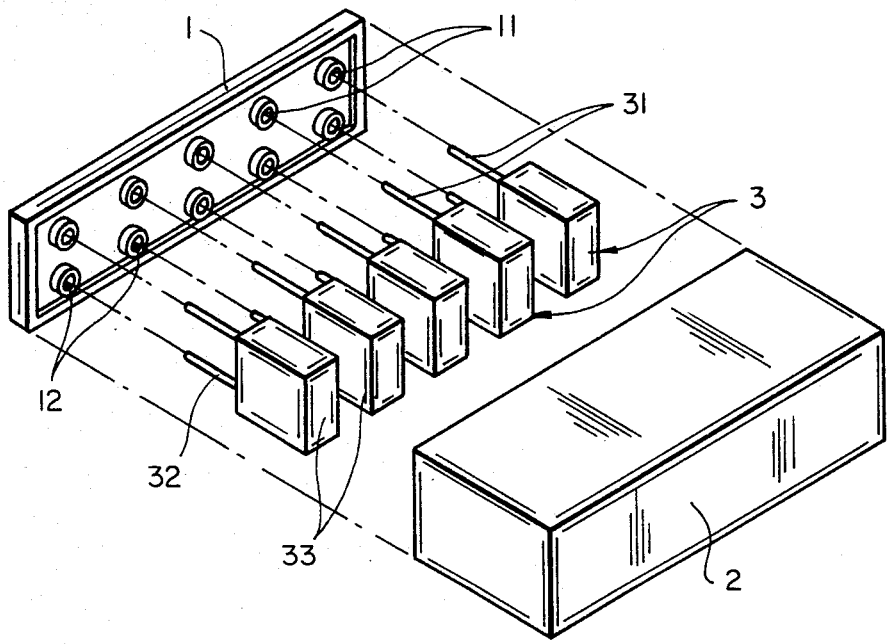
FIG. 1 is an exploded perspective view of an apparatus comprising a plurality of circuit protection devices.
Figure 2:
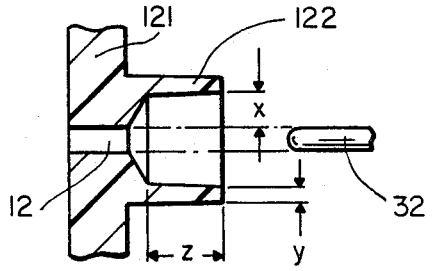
FIG. 2 is a cross-sectional view of one of the electrodes and the corresponding wall portion of FIG. 1.

Referring now to the drawing, FIG. 1 shows a container which comprises a wall member 1 having pairs of exit ports 11, 12 passing therethrough and a cover portion 2 which can be fitted to the wall member. The apparatus also includes five identical circuit protection devices 3, each comprising a pair of electrodes 31 and 32 which are embedded in a PTC conductive polymer element 33 and extend therefrom and fit through the exit ports 11 and 12 in the wall member 1. Each of the exit ports 11 and 12 has the same configuration as shown in FIG. 2 which is a cross-section through a portion of the wall-member 1 which contains an exit port 12. The wall portion comprises a base 121 which defines the exit port 12, and a projection 122, which has a thickness y at its extremity and a height z. When the electrode 32 is fitted into the exit port 12, it is spaced apart from the projection by a distance x which is slightly greater at the top than at the base.

I claim:

1. A circuit protection device which comprises (1) a PTC element composed of a conductive polymer composition which exhibits PTC behavior and which comprises a polymeric component and, dispersed in the polymeric component, carbon black;

(2) two electrodes which are electrically connected to the PTC element and which are connectable to a source of electrical power to cause current to pass through the PTC element; and (3) an enclosure which (a) encloses and is spaced apart from the PTC element; and (b) is provided on its interior surface with a disconformity such that, if an arc is struck between the electrodes, the arc passes through the disconformity.

2. A device according to claim 1 wherein the disconformity has a shape such that the thickness of carbon black which settles thereon, if the device is subjected to successive conversions to a high resistance state, is relatively small.

3. A device according to claim 1 wherein the enclosure comprises a first wall portion which contains a first exit port through which passes one of the electrodes, and a second wall portion which contains a second exit port through which passes the other electrode; at least one of said wall portions comprising (1) a base which defines an exit port; and (2) a projection which projects from the base towards the PTC element, and which is spaced apart from and substantially surrounds the electrode passing through the exit port, the projection being such that its presence substantially reduces erosion of the base when the device is repeatedly converted to a high resistance state under conditions which cause the PTC element to evolve carbonaceous dust.

4. A device according to claim 3 wherein the projection is spaced apart from the electrode by a distance of 0.008 to 0.1 inch.

5. A device according to claim 3 wherein the projection is spaced apart from the electrode by a distance of 0.010 to 0.06 inch.

6. A device according to claim 3 wherein the projection is spaced apart from the electrode by a distance of 0.010 to 0.04 inch.

7. A device according to claim 3 wherein the end of the projection remote from the base provides a surface which surrounds the electrode, which lies in a plane substantially at right angles to the axis of the electrode, and which is at most 0.050 inch wide.

8. A device according to claim 7 wherein the width of said surface which surrounds the electrode is at most 0.030 inch.

9. A device according to claim 3 wherein the width of said surface is 0.008 to 0.020 inch.

10. A device according to claim 3 wherein the projection has a substantially annular cross-section in all planes at right angles to the axis of the electrode.

11. A device according to claim 10 wherein the inner surface of the projection is spaced apart from the electrode by a distance of 0.010 to 0.05 inch.

12. A device according to claim 10 wherein the end of the projection remote from the base provides a surface which surrounds the electrode, which lies in a plane substantially at right angles to the axis of the electrode, and which is at most 0.050 inch wide.

13. A device according to claim 3 wherein the height of the projection above the base is at least 0.030 inch.

14. A device according to claim 11 wherein the height of the projection is 0.060 to 0.1 inch.

15. A device according to claim 3 wherein the first and second wall portions are substantially identical.

16. A device according to claim 15 wherein the enclosure comprises a rigid wall comprising the first and second wall portions.

17. A device according to claim 16 wherein the rigid wall is a monolithic shaped article composed of an electrically insulating polymeric material.

18. A device according to claim 17 wherein substantially the whole of the enclosure is composed of the same material.

19. Apparatus comprising (A) a plurality of circuit protection devices, each of said devices comprising (1) a PTC element composed of a conductive polymer composition which exhibits PTC behavior and which comprises a polymeric component and, dispersed in the polymeric component, carbon black; and (2) two electrodes which are electrically connected to the PTC element and which are connectable to a source of electrical power to cause current to pass through the PTC element; and (B) an enclosure which (1) is composed of electrically insulating material, (2) encloses and is spaced apart from the PTC elements of said devices, and (3) comprises a rigid wall which comprises a plurality of substantially identical wall portions, each of said wall portions comprising (i) a base which defined an exit port through which passes one of the electrodes of said devices, and (ii) a projection which projects from the base towards the PTC element and which is spaced apart from and substantially surrounds the electrode.

20. Apparatus according to claim 19 wherein the enclosure comprises ribs which lie between the PTC elements.

* * * * *